United States Patent [19]

Bares et al.

[11] 4,060,098

[45] Nov. 29, 1977

[54] VALVE PLATE CONSTRUCTION

[76] Inventors: James D. Bares, Woodstock Road, Gates Mills, Ohio 44040; William P. Burke, Jr., 7665 Chesterbrook Road, Chesterland, Ohio 44024

[21] Appl. No.: 643,181

[22] Filed: Dec. 22, 1975

[51] Int. Cl.[2] ..... F16K 15/08

[52] U.S. Cl. ..... 137/594; 417/564; 137/516.15

[58] Field of Search ..... 417/563, 564, 567, 569; 137/516.15, 516.13, 516.11, 516.17, 516.21, 597, 561 R, 561 A, 594; 29/157.1 R

[56] References Cited

U.S. PATENT DOCUMENTS

| | | | |
|---|---|---|---|
| 1,359,006 | 11/1920 | Wardwell | 137/516.15 |
| 1,616,128 | 2/1927 | Knox | 137/516.15 X |
| 1,692,265 | 11/1928 | Blom | 417/567 X |
| 1,707,306 | 4/1929 | Holdsworth | 137/512.1 |
| 2,344,818 | 3/1944 | Hutton | 137/516.13 X |
| 2,728,351 | 12/1955 | Cooper | 137/516.15 |
| 3,944,381 | 3/1976 | Dirk | 417/564 |

*Primary Examiner*—William R. Cline

[57] ABSTRACT

A valve plate construction for use in a refrigerant compressor is disclosed. A method of assembling and joining by brazing a pair of end plates, a spacer plate defining radial passages and a collar defining an axial passage is described. The product is then a unitary structure formed of the various plates having a central axial passage and a plurality of radial passages.

6 Claims, 8 Drawing Figures

VALVE PLATE CONSTRUCTION

BACKGROUND OF THE INVENTION

This invention relates generally to valve plate construction, and more particularly to the construction of a valve plate for use in a refrigerant compressor. The invention is particularly adapted to provide a simple, inexpensive technique of constructing a valve plate assembly which utilizes inexpensive materials and inexpensive manufacturing techniques.

One of the basic prior art valve plate assemblies for refrigerant compressors utilizes a design to provide an annular valve plate which is drilled with radially extending passages to provide radial inflow of gas and has a central axial passage communicating with the discharge valve to provide for axial discharge of a gas.

This particular design of valve plate assembly and the associated refrigerant compressor has proved to be very satisfactory in use and has found wide acceptance for many many reasons. However, while serving in a very effective manner to accomplish its desired function, nevertheless it is rather expensive to manufacture, the manufacturing techniques requiring multiple machining operations on tube of bar stock. Thus while the valve plate assembly functions well in its performance it is relatively expensive and requires precision machining operations.

SUMMARY OF THE PRESENT INVENTION

According to the present invention a valve plate assembly and method for manufacturing the same is provided wherein first and second annular end plates are provided with a spacer plate interposed between said end plates. The spacer plate has a shape to define radial openings. A locating collar is also provided within the annular confines of the spacer plate secured to one of the end plates. The end plates, spacer plates, and central collar are assembled and joined in a manner such that the spacer plate and the two end plates define radially extending passages and an annular opening communicating with the radially extending passages, and an axial bore in the collar presents an axial opening. The utilization of separate parts which are joined together provides for the utilization of relatively inexpensive components and inexpensive joining techniques to provide a very satisfactory valve plate assembly at substantially reduced costs.

DESCRIPTION OF THE PREFERRED EMBODIMENTS

Figure 1:
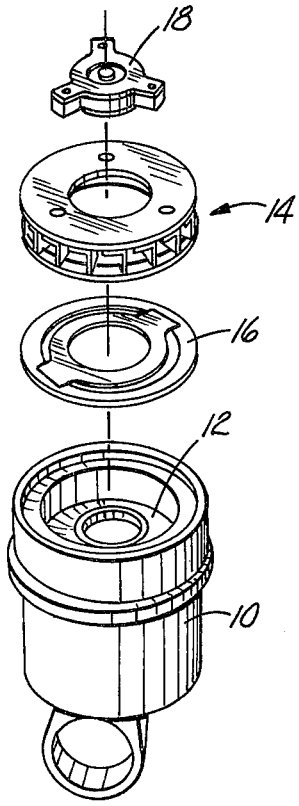
FIG. 1 is a perspective exploded view of a piston and cylinder assembly with a valve plate assembly according to this invention.

Referring now to the drawing, FIG. 1 shows an exploded perspective view of a cylinder barrel designated generally as 10 in which is mounted a piston 12 for reciprocation. The cylinder barrel is closed at one end by a valve plate assembly designated generally as 14 constructed according to the present invention. The valve plate is sealed by a suction reed assembly 16 and a discharge reed assembly 18.

Figure 2:
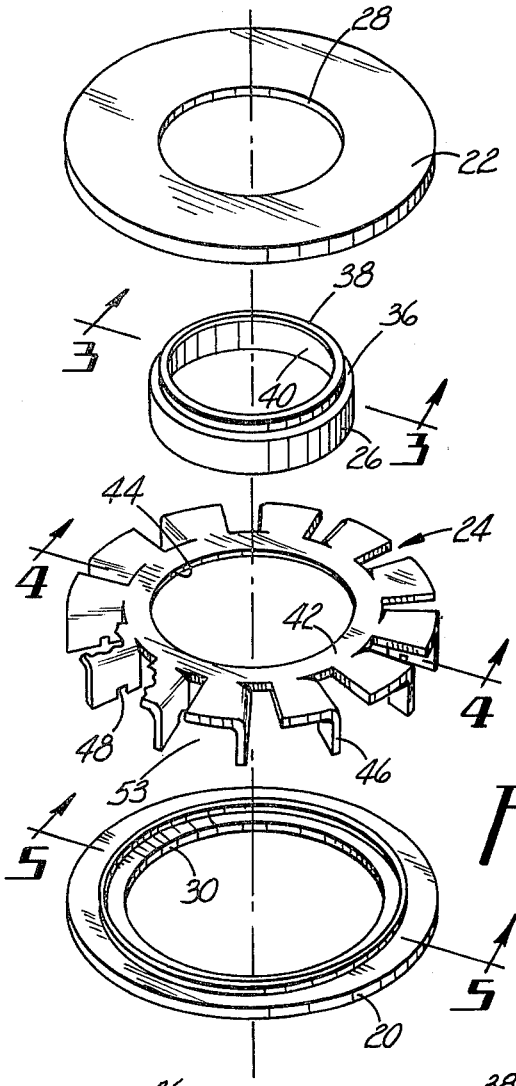
FIG. 2 is an exploded perspective view of the elements of the valve plate assembly of one embodiment of this invention prior to joining of the parts theretogether.
Figure 3:
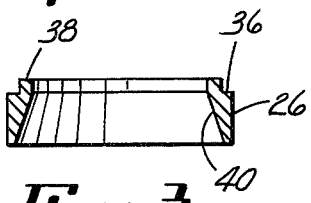
FIG. 3 is a sectional view taken substantially along the plane designated by the line 3—3 of FIG. 2.
Figure 4:
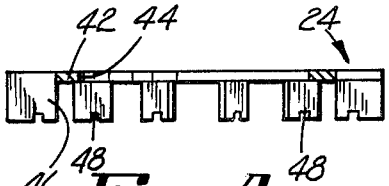
FIG. 4 is a sectional view taken substantially along the plane designated by the line 4—4 of FIG. 2.
Figure 5:
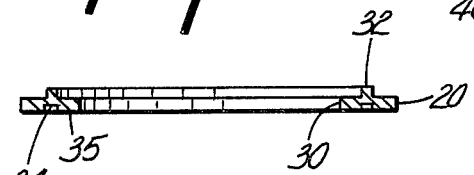
FIG. 5 is a sectional view taken substantially along the plane designated by the line 5—5 of FIG. 2.

The various components of the valve plate assembly are shown in an exploded view of FIG. 2, and in sectional views in FIGS. 3, 4 and 5. The valve plate assembly includes an annular lower end plate 20, an annular upper end plate 22, a spacer plate 24, and a locating collar 26. The upper end plate 22 has a central opening 30 somewhat larger than the opening 28 in the end plate 22. The end plate 20 also includes a coined projection 32 raised on one face thereof with a corresponding coined groove 34 on the opposite face thereof. The face adjacent the coined groove 34 acts as a valve seat 35 for the intake reed assembly 16.

The locating collar 26 has a shoulder 36 which is disposed to fit into the opening 28 in the upper plate 22. The end surface 38 of the shoulder portion 36 serves as a valve seat for the discharge reed assembly 18 when the parts are assembled. The locating collar 26 also has a through tapered bore 40.

The spacer plate 24 is provided with a central annular ring 42 defining a central opening 44. A plurality of legs 46 are stamped out of the extending portion of the central ring 42 and depend axially therefrom. The bottom of the legs 46 are provided with slots 48. The ring 24 is formed out of flat stock, preferably by a progressive stamping die and is relatively inexpensive to make. Also, end plates 20 and 22 and the locating collar 26 are all relatively inexpensively manufactured parts.

Figure 6:
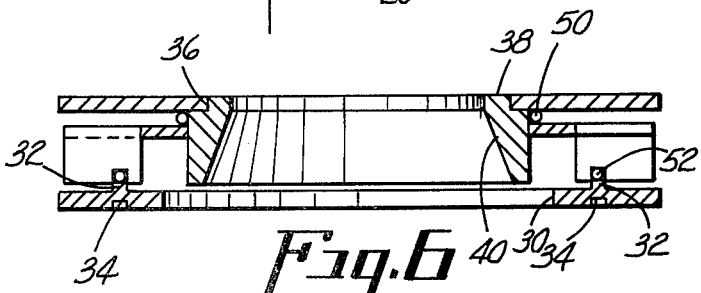
FIG. 6 is a sectional view of the four components of the valve plate assembly assembled together with brazing wire placed thereon prior to the fusing of the brazing wire for joining the parts together.
Figure 7:
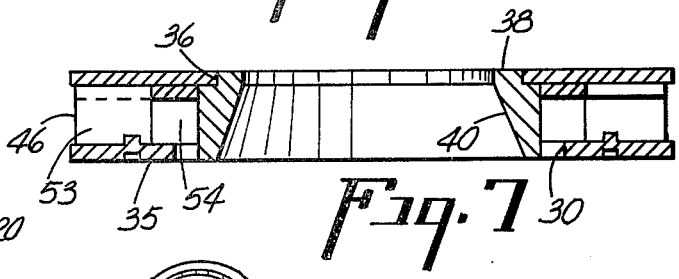
FIG. 7 is a completed assembly of the valve plate assembly after fusing of the assembly shown in FIG. 6.

In order to form the completed valve plate assembly the end plates 20 and 22 are assembled with a spacer plate 24 interposed therebetween and the locating collar 26 inserted into the central opening 28 of the upper plate 22 as shown in FIG. 6. Two rings of brazing material 50 and 52 are provided interleaved with the assembled components at the locations shown, one being between the spacer plate and the upper plate adjacent the collar and the other being within the grooves 48 of the legs 46 of the spacer plate 24 and resting on the raised projection 32 of the lower end plate 20. This assembly can then be placed into a furnace and the furnace brazed without the necessity of jigging or fixturing, and upon heating to the proper temperature and having had proper cleaning, the brazing material will melt and in a conventional manner cause a brazed joining of all of the various parts to the configuration shown in FIG. 7.

In this configuration the legs 46, together with the surfaces of the end plates 22 and 24, will form a plurality of radially extending passages 53 which terminate at an annular opening 54, these passages 53 and annular opening 54 serving as intake passages with the opening 54 being closed by the intake reed 16. The central tapered bore 40 of the locating collar 26 serves as a discharge passage and is closed on the end by means of the discharge reed assembly 18 seating against the valve seat 38. Thus there is provided a relatively inexpensive method or technique or manufacturing a valve plate assembly utilizing relatively inexpensive premanufactured components. A simple brazing operation is all that is necessary to join the parts and a complex machining operation utilizing multiple spindle automatic machines and the like is not required. Also the various components are effectively joined by this brazing technique without the necessity of a jig. Also, the resulting assembly is a very efficient, effective valve plate assembly having large unobstructed radially extending passages and precision formed valve seats which are precisely located.

Figure 8:
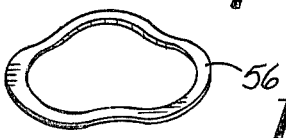
FIG. 8 is a perspective view of another embodiment of a spacer plate which can be utilized to form the valve assembly of the present invention.

Referring now to FIG. 8, another embodiment of a spacer ring designated as 56 is shown which can be utilized in place of the spacer ring 24. This spacer ring basically is an annular savy or sinuous or undulating member which can be likened in shape to a curved leaf spring. Of course, spring characteristics are not necessary or even desirable. This ring can be interposed between the upper and lower plates 20 and 22 and joined thereto such as by brazing or by other means and will also provide by means of its wavy or undulating configuration through axial passages which will communicate with an annular central opening 54.

What is claimed is:

1. A method of forming a valve plate assembly for a compressor comprising the steps of:

providing first and second annular end plates, a spacer plate having a central opening and means to define radial passages, and a central locating collar, said means defining said radial passages including radially extending leg means and means for axially aligning said plates and collar along a central longitudinal axis assembling said plates and said collar with the spacer plate interposed between said end plates and defining with said end plates a plurality of radially extending passages and with said collar disposed internally of said spacer plate and all maintained in axial alignment along said axis, said collar having a central opening defining an axial central bore around said axis, and said collar having wall means, and thereafter interconnecting said plate and said collar in their assembled position with the wall means of the collar and the spacer plate and said end plates defining an annular opening communicating with said radial passages.

2. The method of claim 1 wherein said plates and collar are interconnected by brazing.

3. A valve plate assembly for a compressor comprising, first and second annular end plates, a spacer plate interposed between said end plates, said spacer plate having a ring defining an annular opening, and leg means extending radially with respect to the axis to define with said end plates a plurality of discrete radially extending passages, a central collar disposed internally of said spacer plate secured to one end plate, said collar having a central axial bore, said collar and one of said plates defining an annular opening around said central bore communicating with said radial passages said plates and said collar including means to axially locate each with respect to the others.

4. The invention as defined in claim 3 wherein said means to define axial passages includes axially depending legs on said spacer plate said legs being circumferentially spaced and axially extending.

5. The invention as defined in claim 3 wherein said collar and one of said plates are connected in telescoping relationship with one end surface of the collar disposed normal to the axis of the central bore to define a sealing surface.

6. The invention as defined in claim 5 wherein said collar is formed with a shoulder for locating said one plate.

* * * * *